US012628864B2

(12) United States Patent
Prestia et al.

(10) Patent No.: US 12,628,864 B2
(45) Date of Patent: May 19, 2026

(54) COATED PLUG WRAP TO ENHANCE FILTER HARDNESS

(71) Applicant: PHILIP MORRIS PRODUCTS S.A., Neuchatel (CH)

(72) Inventors: Ivan Prestia, Longara di Calderara di Reno (IT); Alberto Bonici, Modena (IT); Emeric Grandjean, Lausanne (CH); Edoardo Montanari, Bologna (IT); Ivan Chiarini, Bazzano (IT); Michele Del Borrello, Vaso (IT)

(73) Assignee: Philip Morris Products S.A., Neuchâtel (CH)

( * ) Notice: Subject to any disclaimer, the term of this patent is extended or adjusted under 35 U.S.C. 154(b) by 318 days.

(21) Appl. No.: 18/077,972

(22) Filed: Dec. 8, 2022

(65) Prior Publication Data

US 2023/0232891 A1 Jul. 27, 2023

Related U.S. Application Data

(62) Division of application No. 16/303,879, filed as application No. PCT/IB2017/053279 on Jun. 2, 2017, now abandoned.

(30) Foreign Application Priority Data

Jun. 14, 2016 (EP) ..... 16174448

(51) Int. Cl.
*A24D 1/02* (2006.01)
*A24D 3/04* (2006.01)

(52) U.S. Cl.
CPC ..... *A24D 1/02* (2013.01); *A24D 3/04* (2013.01)

(58) Field of Classification Search
CPC . A24C 5/005; A24D 1/02; A24D 3/02; A24D 3/04
USPC ..... 131/331
See application file for complete search history.

(56) References Cited

U.S. PATENT DOCUMENTS

| | | | |
|---|---|---|---|
| 3,705,588 | A | 12/1972 | Tamol et al. |
| 6,676,806 | B1 | 1/2004 | Butt, Sr. |
| 2004/0020504 | A1 | 2/2004 | Snaidr et al. |
| 2009/0223529 | A1 | 9/2009 | Hampl, Jr. et al. |
| 2014/0238425 | A1 | 8/2014 | Kaljura et al. |
| 2014/0326261 | A1 | 11/2014 | Griesmayr et al. |

(Continued)

FOREIGN PATENT DOCUMENTS

| | | | |
|---|---|---|---|
| CN | 201062330 | Y | 5/2008 |
| CN | 102953295 | A | 3/2013 |

(Continued)

OTHER PUBLICATIONS

International Search Report and Written Opinion for PCT/IB2017/053279, issued by the European Patent Office, Aug. 23, 2017; 12 pgs.

(Continued)

*Primary Examiner* — Philip Y Louie
*Assistant Examiner* — Yana B Krinker
(74) *Attorney, Agent, or Firm* — Mueting Raasch Group

(57) ABSTRACT

A method for enhancing hardness of a filter for a smoking article includes disposing a plug wrap about filter material; and applying a hardness-enhancing coating composition to the plug wrap after the plug wrap has been disposed about the filter material to enhance the hardness of the filter.

10 Claims, 2 Drawing Sheets

(56) References Cited

U.S. PATENT DOCUMENTS

| | | | | |
|---|---|---|---|---|
| 2015/0107613 | A1* | 4/2015 | Lewis | A24D 3/063 131/334 |
| 2016/0213057 | A1* | 7/2016 | Goldoni, Jr. | D21H 19/20 |

FOREIGN PATENT DOCUMENTS

| | | | | |
|---|---|---|---|---|
| CN | 103974634 | A | 8/2014 | |
| GB | 1453951 | A | 10/1976 | |
| JP | S62206098 | A | 9/1987 | |
| JP | 2004018091 | A | 1/2004 | |
| JP | 2014-521360 | A | 8/2014 | |
| JP | 2015532106 | A | 11/2015 | |
| KR | 1020100015916 | | 2/2010 | |
| RU | 2305480 | C2 | 9/2007 | |
| RU | 2503383 | C2 | 1/2014 | |
| WO | WO 2008/116739 | | 10/2008 | |
| WO | WO 2011/114530 | A1 | 9/2011 | |
| WO | WO 2014/060455 | A1 | 4/2014 | |
| WO | WO-2015035137 | A1 * | 3/2015 | A24C 5/005 |

OTHER PUBLICATIONS

Extended European Search Report for EP 16174448.7, issued by the European Patent Office, Dec. 5, 2016; 8 pgs.

Russian Office Action issued by the Patent Office of the Russian Federation for Application No. 2018142272, issued on Sep. 8, 2020; 11 pgs. including English Translation.

Melnikova et al., "The use of synthetic materials in the restoration of monumental painting," K.I. Maslov; M., S-P., 2000; chapter 6: 8 pgs.

Chinese Office Action for Chinese Application No. 201780030824.5, issued by the China National Intellectual Property Administration, dated Mar. 2, 2021; 17 pgs. including English Translation.

Japanese Office Action for Japanese Application No. 2018-565892, issued by the Japanese Patent Office, dated Apr. 15, 2021; 11 pgs. including English translation.

Japanese Office Action for JP Application No. 2018565892 issued by the Japanese Patent Office on Dec. 8, 2021; 10 pgs. including English translation.

EP Search Report for EP Application No. 24205068.0 issued by the European Patent Office on Jan. 28, 2025; 8 pgs.

* cited by examiner

COATED PLUG WRAP TO ENHANCE FILTER HARDNESS

This is a divisional application of U.S. patent application Ser. No. 16/303,879, filed 21 Nov. 2018, which is the § 371 U.S. National Stage of International Application No. PCT/IB2017/053279, filed 2 Jun. 2017, which claims the benefit of European Application No. 16174448.7, filed 14 Jun. 2016, the disclosures of which are incorporated by reference herein in their entireties.

This invention relates to smoking articles and filters for smoking articles that have enhanced hardness. More particularly, this invention relates to coating a plug wrap with a hardness-enhancing coating after the plug wrap is wrapped around filter material.

Combustible smoking articles, such as cigarettes, typically have shredded tobacco, usually in cut filler form, surrounded by a paper wrapper forming a tobacco rod. A cigarette is employed by a smoker by lighting one end of the cigarette and burning the tobacco rod. The smoker then receives mainstream smoke by drawing on the opposite end or mouth end of the cigarette, which typically contains a filter. The filter is positioned to entrap some constituents of mainstream smoke before the mainstream smoke is delivered to a smoker.

Filters in smoking articles typically include filter material surrounded by a plug wrap. The plug wrap contributes to the rigidity of the filter. Plug wraps with enhanced stiffness, such as plug wraps formed from higher weight basis paper, have been made to produce firmer, more rigid filters. Plug wraps with enhanced stiffness may aid in stubbing out the smoking article due to enhanced longitudinal rigidity and may result in the perception of a higher quality product when picked up by a consumer due to enhanced radial hardness.

However, circumscribing a coated plug wrap around filter material may present challenges due to the increased stiffness of the plug wrap. For example, equipment on filter manufacturing lines may need to be altered so that the stiffer plug wrap can be wrapped around the filter material.

It is desirable to provide a smoking article with improved filter hardness. It is also desirable to manufacture a filter having improved hardness using standard filter making equipment.

In various aspects of the present invention, there is provided a smoking article comprising a smokable material and a filter downstream of the smokable material. The filter comprises filter material and a plug wrap disposed about the filter material. The plug wrap comprises an inner surface facing towards a longitudinal axis of the filter and an outer surface facing away from the longitudinal axis of the filter. The outer surface of the plug wrap comprises a hardness-enhancing coating. The coating may enhance the hardness of the filter. Preferably, the coating increases the longitudinal hardness of the filter and the radial hardness of the filter. The coating preferably comprises polyvinyl alcohol.

In various aspects of the present invention, there is provided a method for enhancing hardness of a filter for a smoking article. The method comprises disposing a plug wrap about filter material; and applying a hardness-enhancing coating composition to the plug wrap after the plug wrap has been disposed about the filter material to enhance the hardness of the filter.

Various aspects of the filters, smoking articles, and methods of the invention may provide one or more advantages relative to prior filters, smoking articles, and methods. For example, filters having enhanced longitudinal hardness may result in easier stubbing out of a smoking article due to increased rigidity. By way of another example, a filter having increased radial hardness may provide a perception of increased quality when grasped by a consumer. The filter portion of a smoking article having increased radial harness may have a crisper touch than traditional plug wraps. A filter having a crisper touch may feel harder, stiffer, inflexible, or more firm to the touch than traditional plug wraps, which are associated with an elastic touch or feel. Filters of the present invention are preferably made using standard filter making machines and processes and then are coated after being made by such machines and processes. Filters and methods of the present invention may provide increased filter hardness without adding components or filter material in the area through which the mainstream smoke passes. These and other advantages will be readily evident to those of skill in the art upon reading and understanding the present disclosure.

Any suitable filter may be used in accordance with the present invention. A filter includes filter material and a plug wrap disposed around the filter material. The plug wrap may be coated with any suitable hardness-enhancing coating after the plug wrap has been wrapped around the filter material. Preferably, the plug wrap is wrapped around the filter material using standard filter manufacturing equipment. Because the plug wrap may be coated after being wrapped around the filter material, the plug wrap does not have enhanced hardness during the initial filter manufacturing phase. Thus, standard filter manufacturing equipment lines, without modification, may be used to form the filter prior to coating.

The plug wrap may be coated with any suitable hardness-enhancing coating composition. Preferably, the coating enhances radial harness and longitudinal hardness of a filter that includes the coated plug wrap. As used herein, the term "radial hardness" refers to resistance to compression is a direction transverse to a longitudinal axis. Radial hardness of a filter may be determined by applying a load across a filter, transverse to the longitudinal axis of the filter, and measuring the average (mean) depressed diameters of the filters, which may be in isolation or incorporated into smoking articles. Hardness=(depressed diameter/nominal non-depressed diameter)×100%. This testing is preferably carried out at an ambient temperature of 22±2 degrees centigrade and 50% relative humidity according to ISO 187 two weeks after the hardness-enhancing coating. Testing can be accomplished using a device made commercially available under the trade designation Hardness Tester H10 (Borgwaldt KC GmbH, Hamburg, Germany). Preferably, the applied load is 250 grams. Preferably, an average hardness is determined from 20 tested filters. Preferably, filters of the present invention that include a hardness-enhancing coating on a plug wrap have an average radial hardness of at least 2% greater than filters that are essentially the same except that the filters have a plug wrap to which the coating is not applied. For example, average hardness may be from about 2% to about 5% harder than filter not having coating.

As used herein, "diameter" is used to describe the maximum dimension in the transverse direction (transverse to the longitudinal axis) of the filter or a smoking article that includes the filter. The longitudinal axis of the filter or smoking article is in the direction of the length of the filter or smoking article. For purposes of the present disclosure, the term "radius" refers to a transverse distance from the longitudinal axis to an edge of the filter or smoking article. Typically, the filter and smoking article will be cylindrically shaped. However, the filter, the smoking article, or the filter and the smoking article do not need to be cylindrically shaped.

As used herein, "longitudinal hardness' refers to resistance to compression in a longitudinal direction. Longitudinal hardness of a filter may be determined by applying a load to the filter along the longitudinal axis of the filter and measuring the load at which serious damage to the filter occurs. Serious damage is considered to occur when the load needed to compress the filter is decreased by 50%. Testing may also be carried out by applying a load of 16 N, which is representative of the force applied by a consumer when extinguishing a smoking article. Deformation, preferably in millimetres, may be measured. Testing is preferably carried out at an ambient temperature of 22±2 degrees centigrade. Testing can be accomplished using a device made commercially available under the trade designation Instron 5944 dynamometer (Illinois Tool Works, Glenview, Illinois, U.S.A.) using a 500 N load cell. Preferably, an average hardness is determined from 20 tested filters. Preferably, filters of the present invention that include a hardness-enhancing coating on a plug wrap have an average longitudinal hardness of at least 2N greater (load as serious damage) than filters that are essentially the same except that the filters have a plug wrap to which the coating is not applied. For example, average hardness may be from about 2N to about 5N harder than filter not having coating.

Any suitable hardness-enhancing coating composition may be applied to plug wrap of a filter according to the present invention. Preferably, the hardness-enhancing coating composition does not result in a coating that adversely alters the perception of taste during smoking of a smoking article that includes the coated filter. In some preferred embodiments, a hardness-enhancing coating composition comprises one or more components, such as binders or other additives, used in cigarette manufacturing. For example, the coating composition may comprise a suitable binder used in cigarette paper, tipping paper or plug wraps.

Examples of suitable materials that may be included in a hardness-enhancing coating composition are starch, polyacrylamide derivatives, styrene butadiene, styrene acrylics, dextrin, oxidized starch, ethyl cellulose, acetyl cellulose, carboxymethyl cellulose, hydroxyethyl cellulose or other suitable cellulose derivatives; pectins; guar gum; carob bean kernel meal; agar; sodium alginate or other suitable alginates; and the like.

The coating composition may comprise one or more suitable hardness-enhancing materials and an appropriate solvent or liquid carrier. Suitable solvents and liquid carriers may vary based on the hardness-enhancing agent or agents used. Often polar liquids, such as water, ethanol, or a combination of water and ethanol, are suitable solvents or carriers. In some situations, non-polar solvents may be suitable.

The coating composition may comprise any suitable amount of hardness-enhancing material. For example, the coating composition may comprise from about 5 to about 50 weight percent hardness-enhancing material. In some preferred embodiments, the coating composition comprises from about 10 to about 40 weight percent hardness-enhancing material. For example, the coating composition comprises from about 15 to about 25 weight percent hardness-enhancing material.

The hardness-enhancing coating composition may be applied at any suitable thickness. For example, the thickness of the coating in the wet state may be from about 10 micrometers to about 200 micrometers. For example, the thickness of the wet coating may be from about 20 micrometers to about 100 micrometers. In some preferred embodiments, the thickness of the wet coating applied is about 40 micrometers to about 60 micrometers.

The coating composition may be applied to an entire outer surface of the plug wrap or one or more portions of the outer surface of the plug wrap. For example, the coating composition may be applied as one or more strips. Preferably, the one or more strips have a width of about 5 millimeters or more. The strips may be disposed around the circumference of the plug wrap, may be disposed along the length of the plug wrap, or may be disposed in any other suitable manner on the plug wrap.

The coating composition may be applied in any suitable manner. For example, the coating composition may be sprayed on the plug wrap, printed on the plug wrap, brushed or rolled on the plug wrap or the like.

Preferably, the coating is applied by spraying or printing. Preferably, the coating composition is applied on a filter manufacturing line. The coating composition may be applied at any suitable rate and may depend on the speed of the filter manufacturing machine speed. For example, the coating composition may be applied at a machine speed of from about 20 meters/min to about 500 meters/min. The composition may be applied at a rage of from about 5 grams/min to about 250 grams/min.

In some preferred embodiments, the coating composition comprises, consists essentially of, or consists of a solution or dispersion of polyvinyl alcohol. Preferably, the coating composition comprises from about 5 to about 50 weight percent polyvinyl alcohol, more preferably from 10 to 40 weight percent polyvinyl alcohol, and even more preferably from 15 to 25 weight percent, depending the viscosity of the polyvinyl alcohol solution and temperature. Any suitable solvent or liquid carrier may be employed. Examples of suitable solvents and liquid carriers include any polar solvent, for example water, ethanol, or a combination of water and ethanol.

The polyvinyl alcohol may have any suitable molecular weight. For example, the polyvinyl alcohol may have a molecular weight from about 40 grams/mol to about 150 000 grams/mol; preferably from about 100 000 grams/mol to about 125 000 g/mol.

The polyvinyl alcohol may be hydrolized or not hydrolized. Preferably polyvinyl alcohol is not hydrolized. The coating composition may comprise, consist essentially of, or consist of a polyvinyl alcohol homopolymer solution or dispersion.

The coating composition may contain polyvinyl alcohol having any suitable solid content. For example, the polyvinyl alcohol solid content may be from about 10 weight percent to about 70 weight percent; preferably from about 5 to about 50 weight percent polyvinyl alcohol solid content. In some preferred embodiments, the coating composition comprises 10 to 40 weight percent polyvinyl alcohol solid content; preferably from about 15 to about 25 weight percent, depending the viscosity of the polyvinyl alcohol composition and temperature. The solid content may be determined by measuring oven volatiles.

The coating composition may be dried, for example to remove solvent, in any suitable manner to produce a hardened coating on the plug wrap. Preferably, the coating composition is dried or cured under ambient conditions without the use of additional heating. Alternatively, additional heating may be used to dry the coating. Air flow or vacuum conditions may optionally be employed.

The dried coating may have any suitable thickness. For example, the thickness of the dried coating may be from about 1 micrometers to about 100 micrometers. For example, the thickness of the coating may be from about 10 micrometers to about 50 micrometers. In some preferred embodiments, the thickness of the dried coating is from about 20 micrometers to about 40 micrometers.

In some preferred embodiments, the coating comprises, consists essentially of, or consists of polyvinyl alcohol. The polyvinyl alcohol may have any suitable molecular weight. For example, polyvinyl alcohol may have a molecular weight from about 40 grams/mol to about 150 000 grams/mol; preferably from about 100 000 grams/mol to about 125 000 g/mol.

Any suitable plug wrap may be coated with a hardness-enhancing coating. Preferably, the plug wrap comprises, consists essentially of, or consists of a paper plug wrap.

The plug wrap may have any suitable basis weight. Preferably, the plug wrap has a basis weight from about 20 grams per square meter to about 120 grams per square meter. More preferably, the plug wrap has a basis weight from about 25 grams per square meter to about 100 grams per square meter; and even more preferably from about 40 grams per square meter to about 80 grams per square meter. In some preferred examples, the plug wrap has a basis weight of about 80 grams per square meter.

The plug wrap may have any suitable thickness. Suitable plug wrap papers may have a thickness of about 25 micrometers to about 200 micrometers; preferably from about 50 micrometers to about 150 micrometers. In some preferred embodiments, a plug wrap has a thickness from about 75 micrometers to about 125 micrometers.

The plug wrap, before application of the coating composition, may have any suitable porosity or may even be non-porous. For example, the plug wrap may have a relatively high porosity, such as greater than about 1,000 Coresta units, or greater than about 5,000 Coresta units. In addition, or in the alternative, the plug wrap may have a porosity of less than about 10,000 Coresta units.

The plug wrap may be wrapped about any suitable filter material. Examples of suitable filter material include cellulose esters such as cellulose acetate, polylactic acid (PLA), cellulosic material, polypropylene, cotton, flax, hemp, or any degradable filtration media, or a combination or blend of any two or more of filter materials. In preferred embodiments, the filter material includes polymeric filter material such as polylactic acid, cellulose esters, and blends thereof. Preferably, the filter material includes a cellulose ester. Examples of cellulose esters that can be used to form filter material include cellulose acetates, cellulose propionates and cellulose butyrates with varying degrees of substitution, as well as mixed esters thereof. Examples of such mixed esters include cellulose acetate propionate, cellulose acetate butyrate, and cellulose acetate propionate butyrate. Preferably, the filter material comprises cellulose acetate.

The filter material preferably includes fibers. Preferably, the filter material comprises a fibrous polymeric filter material. In preferred embodiments, the filter material comprises cellulose acetate fibers or polylactic acid fibers. In preferred embodiments, the filter material includes fibers or bundles of fibers in the form of a tow band.

A filter may include one or more optional binding agents. Preferably, a filter that includes a binding agent comprises polymeric fibers. The binding agent can bind the polymeric fibers together. Preferably, the binding agent, if included, is a plasticizer. As used herein, a "plasticizer" is a solvent, that when applied to polymeric fibers, solvent-bonds the fibers together. Examples of plasticizers include triacetin (also known as glycerol triacetate), diethylene glycol diacetate, triethylene glycol diacetate, tripropion, acetyl triethyl citrate, triethyl citrate and mixtures of one or more thereof. One or more plasticizers may be mixed with, for example, polyethylene glycol and contacted with the polymeric fibers to solvent-bond the fibers together. The fibers may be contacted with a binding agent in any suitable manner. Preferably, a composition comprising the binding agent is sprayed on the polymeric fibers.

For purposes of the present disclosure, a filter includes filter material and a plug wrap circumscribing the filter material. The filter may include additional material, such as activated carbon; flavorants, which may be in the form of compounds, flavor threads, beads, capsules or the like; or any other suitable material. The additional material may be incorporated into the filter material or may be disposed in cavities between plugs of filter material in, for example, a plug-space-plug configuration. In such a configuration, a plug wrap as described herein may be particularly advantageous by adding enhanced structural hardness over the cavities.

Filters of the present invention may have any suitable dimensions. Typically, the filters are cylindrical in shape. Preferably, the filter has a diameter in a range from about 5 mm to about 10 mm. Preferably the filters have a length in a range from about 50 to about 150 mm. Preferably the diameter of the filter is the same or substantially the same as the diameter of the smoking article into which it is incorporated.

Filters of the present invention may be incorporated into any suitable smoking article in any suitable manner. Preferably, the filter is incorporated into a smoking article downstream of smokable material. The term "downstream" refers to relative positions of elements of the smoking article described in relation to the direction of mainstream smoke as it is drawn from a smokable material and into a user's mouth.

The term "smoking article" includes cigarettes, cigars, cigarillos and other articles in which a smokable material, such as a tobacco, is lit and combusted to produce smoke. The term "smoking article" also includes articles in which smokable material is not combusted, such as but not limited to smoking articles that heat a smoking composition directly or indirectly, or smoking articles that use air flow or a chemical reaction, with or without a heat source, to deliver nicotine or other materials from the smokable material.

As used herein, the term "smoke" is used to describe an aerosol produced by a smoking article. An aerosol produced by a smoking article may be, for example, smoke produced by combustible smoking articles, such as cigarettes, or aerosols produced by non-combustible smoking articles, such as heated smoking articles or non-heated smoking articles.

Referring now to the drawings, in which some aspects of the present invention are illustrated. It will be understood that other aspects not depicted in the drawings fall within the scope and spirit of the present invention. The schematic drawings are not necessarily to scale. Like numbers used in the figures refer to like components, steps and the like. However, it will be understood that the use of a number to refer to a component in a given figure is not intended to limit the component in another figure labelled with the same number. In addition, the use of different numbers to refer to components in different figures is not intended to indicate that the different numbered components cannot be the same or similar to other numbered components.

Figure 1:
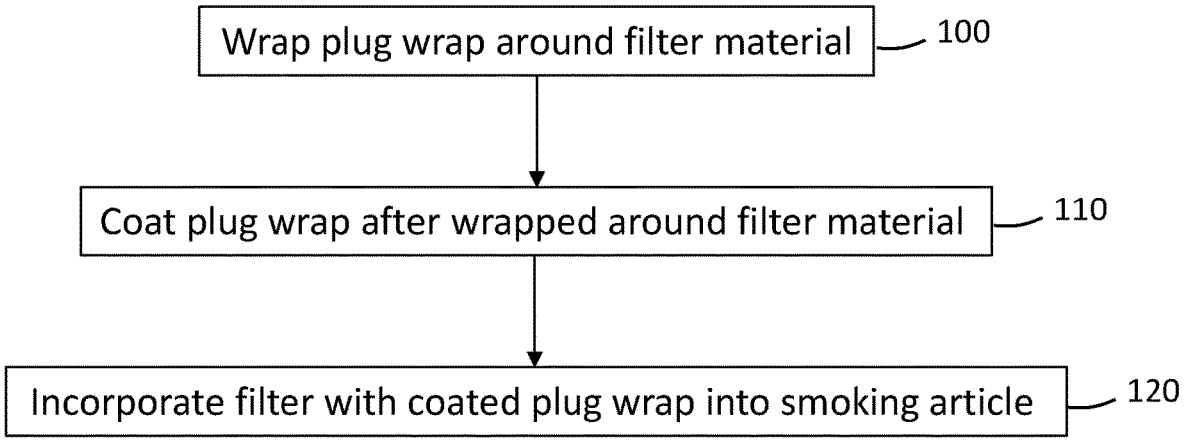
FIG. 1 is a flow diagram of an embodiment of a method for manufacturing a smoking article having a filter with enhanced hardness.

Referring now to FIG. 1, an embodiment of a method for manufacturing a smoking article having a filter with enhanced hardness is depicted. The method includes wrapping a plug wrap around filter material to form a filter (100). The filter material may be formed on conventional filter-forming equipment and manufacturing lines. For example, the filter material may be formed from cellulose acetate tow using standard equipment. Once formed, the plug wrap may be wrapped around to the filter material to form the filter. A filter precursor consisting of a multiple of filter units may be formed and then cut to appropriate lengths to form the filter. Once the filter is formed, the plug wrap is coated (110) with a hardness-enhancing composition and dried to form a coating that enhances the hardness, preferably the radial hardness and the longitudinal hardness, of the filter. Preferably, the plug wrap is coated at high speeds on the manufacturing line. The filter with the coated plug wrap may then be incorporated into a smoking article (120) in a manner as generally known in the art.

Figure 2:
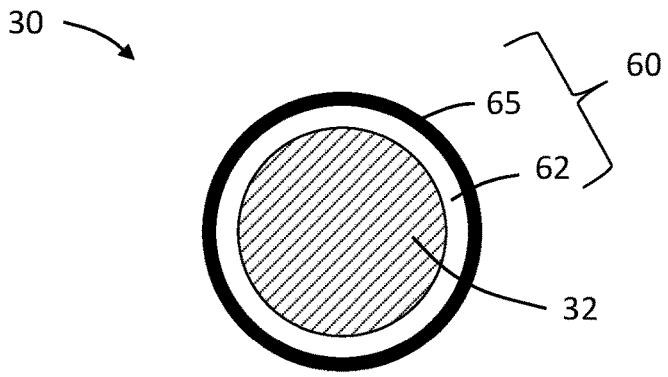
FIG. 2 is a schematic sectional view of an embodiment of a filter having a coated plug wrap.

Referring now to FIG. 2, a schematic sectional view of an embodiment of a filter 30 is shown. The filter 30 includes filter material 32 forming a core and a plug wrap 62 circumscribing the filter material 32. An outer surface (the surface facing away from the filter material) of the plug wrap 62 is coated with a hardness-enhancing coating 65.

Figure 3:
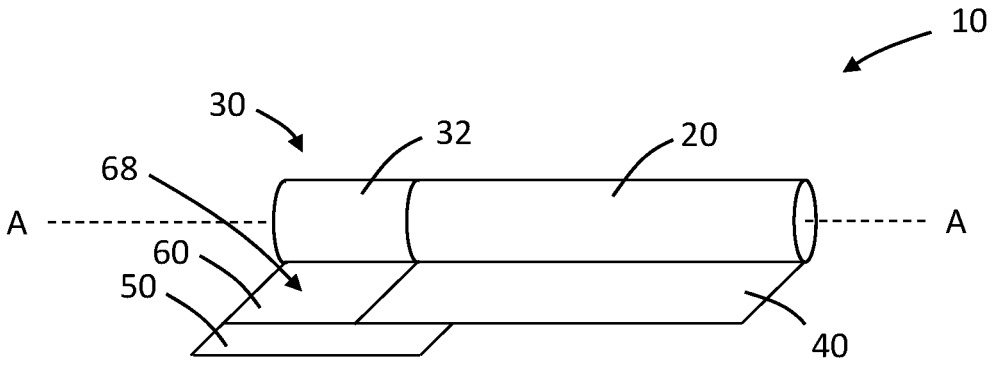
FIG. 3 is a schematic perspective view of an embodiment of a partially unrolled cigarette having a filter with a coated plug wrap.

Referring now to FIG. 3, a schematic perspective view of an embodiment of a partially unrolled smoking article 10, in this case a cigarette, is depicted. The smoking article 10 is depicted as partially unrolled merely to illustrate representative components of the article. The smoking article 10 includes a rod of smokable material 20, such as a tobacco rod, and a filter 30 downstream of the smokable material 20. The filter 30 and the rod 20 are coaxially aligned with the longitudinal axis of the smoking article 10, which axis is depicted by line A-A. The depicted smoking article 10 includes a coated plug wrap 60, cigarette paper 40, and tipping paper 50. The cigarette paper 40 circumscribes at least a portion of the rod 20. Tipping paper 50 or other suitable wrapper circumscribes the coated plug wrap 60 and a portion of the cigarette paper 40 as is generally known in the art. The filter 30 includes the coated plug wrap 60 and filter material 32. The plug wrap includes an inner surface 62 that faces the longitudinal axis A-A of the smoking article 10 and that may contact the filter material 32. The coated plug wrap includes an opposing outer surface (not shown in FIG. 3) that faces away from the longitudinal axis A-A of the smoking article 10. The hardness-enhancing coating (not shown in FIG. 3) is on the outer surface of the plug wrap 60 (see, for example, FIG. 2).

The exemplary embodiments described above are not limiting. Other embodiments consistent with the exemplary embodiments described above will be apparent to those skilled in the art.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Thus, methods, systems, apparatuses, assemblies and articles for coated plug wraps for enhancing filter hardness are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, electrical arts, and aerosol generating article manufacturing or related fields are intended to be within the scope of the following claims.

The invention claimed is:

1. A method for enhancing hardness of a filter for a smoking article comprising:

disposing a plug wrap about filter material; and applying a hardness-enhancing coating composition to the plug wrap after the plug wrap has been disposed about the filter material to enhance the hardness of the filter.

2. A method according to claim 1, wherein the coating composition comprises polyvinyl alcohol having a solid content from 10% to 70%.

3. A method according to claim 2, wherein the polyvinyl alcohol has a molecular weight in a range from 40 to 125,000 grams/mol.

4. A method according to claim 1, wherein the coating composition consists essentially of polyvinyl alcohol.

5. A method according to claim 1, wherein the coating composition is applied to the plug wrap at a rate from 20 meters/min to 50 meters/min.

6. A method according to claim 1, further comprising curing of the coated filter to remove solvent from the applied coating composition.

7. A method according to claim 6, wherein the drying occurs at ambient temperature.

8. A method according to claim 6, wherein the coating composition is applied to the plug wrap in an amount sufficient to produce a coating layer having a thickness is a range from 2 micrometers to 200 micrometers after the filter is dried.

9. A method according to claim 1, wherein the filter has a longitudinal hardness that is at least 2N greater than a filter having a plug wrap to which the coating is not applied.

10. A method according to claim 1, wherein the filter has a radial hardness that is at least 2% greater than a filter having a plug wrap to which the coating is not applied.

* * * * *